US011415121B2

(12) United States Patent
Tumer et al.

(10) Patent No.: US 11,415,121 B2
(45) Date of Patent: Aug. 16, 2022

(54) PLATE FIN HEAT EXCHANGER FOR PUMP ASSEMBLY

(71) Applicant: Parker-Hannifin Corporation, Cleveland, OH (US)

(72) Inventors: Aylin D. Tumer, Seattle, WA (US); James M. Campbell, Concord, NC (US); Peter Ranker, Mocksville, NC (US)

(73) Assignee: Parker-Hannifin Corporation, Cleveland, OH (US)

( * ) Notice: Subject to any disclaimer, the term of this patent is extended or adjusted under 35 U.S.C. 154(b) by 0 days.

(21) Appl. No.: 16/972,064

(22) PCT Filed: Jun. 12, 2019

(86) PCT No.: PCT/US2019/036646

§ 371 (c)(1),
(2) Date: Dec. 4, 2020

(87) PCT Pub. No.: WO2019/241312

PCT Pub. Date: Dec. 19, 2019

(65) Prior Publication Data

US 2021/0123427 A1 Apr. 29, 2021

Related U.S. Application Data

(60) Provisional application No. 62/684,422, filed on Jun. 13, 2018.

(51) Int. Cl.

| | |
|---|---|
| ***F04B 39/06*** | (2006.01) |
| ***F04B 39/12*** | (2006.01) |
| *F04B 17/03* | (2006.01) |

(52) U.S. Cl.
CPC ..... *F04B 39/06* (2013.01); *F04B 39/125* (2013.01); *F04B 17/03* (2013.01); *F04B 39/122* (2013.01)

(58) Field of Classification Search
CPC ..... F04B 17/03; F04B 39/06; F04B 39/122; F04B 39/125
See application file for complete search history.

(56) References Cited

U.S. PATENT DOCUMENTS 2,463,766 A * 3/1949 Hadley ..... F04B 45/04 417/566
3,986,798 A * 10/1976 Lindell ..... F04B 39/06 417/564
4,536,132 A * 8/1985 Tenney ..... F02B 63/06 165/122

FOREIGN PATENT DOCUMENTS

FR 332 224 10/1903
FR 1 405 835 7/1965

OTHER PUBLICATIONS

International Search Report and Written Opinion issued by WIPO for corresponding International Patent Application No. PCT/US2019/036646 dated Sep. 18, 2019.

* cited by examiner

*Primary Examiner* — Patrick Hamo
(74) *Attorney, Agent, or Firm* — Renner, Otto, Boisselle & Sklar, LLP

(57) ABSTRACT

A cover for an air compressor or pump includes a main plate body (12) having a first surface and a second surface opposite from the first surface, a plurality of external fins (18) that are formed on the first surface and protrude outwardly from the first surface, and a plurality of internal fins (42) that are arranged proximate the second surface and extend in a direction opposite to a direction in which the plurality of external fins extend. Heat from the air compressor or pump is received by the plurality of internal fins and flows through the main plate body, whereby a temperature of a fluid exiting the air compressor or pump is reduced.

20 Claims, 6 Drawing Sheets

PLATE FIN HEAT EXCHANGER FOR PUMP ASSEMBLY

This application is a national phase of International Application No. PCT/US2019/036646 filed Jun. 12, 2019 which claims benefit of U.S. Provisional Application No. 62/684,422 filed on Jun. 13, 2018 and published in the English language reference of which is incorporated herein.

FIELD OF INVENTION

The present invention relates to plate fin heat exchangers, and more specifically to plate fin heat exchangers that use countercurrent or parallel flow.

BACKGROUND OF THE INVENTION

Various applications use pump assemblies that generate heat during operation. Exemplary applications include power generation, oil and gas refining, industrial applications, transportation, and medical devices. A pump assembly may include a pump or a compressor for moving a fluid through a system. However, conventional pumps or compressors may be deficient in the manner of dissipating heat during operation of the pump assembly. The increased temperature of the fluid moving through the system may negatively impact the efficiency of the device. For example, the hot temperature of air that is compressed and outputted from an air compressor system impacts the efficiency of a device that receives the air from the compressor for operation of the device.

SUMMARY OF THE INVENTION

A cover for a pump or a compressor in a pump assembly according to the present application is a plate fin heat exchanger that includes both internal and external heat fins. The external heat fins are arranged on an outer side of the cover that faces away from the pump assembly, and the internal heat fins are arranged to face an outlet of the pump assembly. Using both the internal and external heat fins enables heat to more efficiently be removed from a fluid in the pump assembly. The cover has an internal chamber that is formed within a main body of the cover and supports the internal heat fins to increase the internal surface area of the cover that faces the pump assembly. In exemplary embodiments, the internal heat fins may face a cylinder assembly of the pump assembly.

Using the internal heat fins and the external heat fins enables heat transfer from the fluid to the cover to be significantly increased. For example, the cover having the internal chamber and internal heat fins may be used in an air compressor to reduce a temperature of the outlet air of the compressor, such as by approximately ten degrees. The internal heat fins and external heat fins may have any suitable pattern and the pattern may be dependent on the application. The internal heat fins and the external heat fins may be straight fins that are arranged in ordered patterns. The fins may be arranged parallel with each other or perpendicular to each other, and the fins may be integrally formed with the main body.

According to an aspect of the invention, a cover for an air compressor or a pump in a pump assembly includes a main plate body having a first surface and a second surface opposite from the first surface, a plurality of external fins that are formed on the first surface and protrude outwardly from the first surface, and a plurality of internal fins that are arranged proximate the second surface and extend in an opposite direction relative to a direction in which the plurality of external fins extend, such that heat from the air compressor or pump is received by the plurality of internal fins and flows through the main plate body and a temperature of a fluid exiting the air compressor or pump is reduced.

According to another aspect of the invention, a method of reducing a temperature of an output fluid in a pump assembly including a pump or compressor includes providing a plate fin heat exchanger having a main body, a cylinder facing surface that faces a cylinder of the air compressor, an outer surface opposite from the cylinder facing surface, a plurality of external fins that extend outwardly from the outer surface, and a plurality of internal fins that extend inwardly toward the cylinder and in a direction opposite relative to the plurality of external fins, and supplying compressed air into a pump chamber of the cylinder, wherein heat from the compressed air is transferred to the plurality of internal fins and flows through the cover.

Other systems, devices, methods, features, and advantages of the present invention will be or become apparent to one having ordinary skill in the art upon examination of the following drawings and detailed description. It is intended that all such additional systems, methods, features, and advantages be included within this description, be within the scope of the present invention, and be protected by the accompanying claims.

DETAILED DESCRIPTION

A cover having internal and external heat fins according to the present application may be used in pump assemblies for various applications. A pump assembly may include a pump or a compressor. Exemplary applications for pumps or compressors include power generation, oil and gas refining, industrial applications, transportation, and medical devices. Suitable applications may have a wide range of operating temperatures. Air compressors of any size may be suitable. For example, the cover may be used in larger air compressors for reducing condensation. Suitable pumps and compressors also include vacuum pumps, articulated or non-articulated piston compressors or pumps, and diaphragm pumps such as linear diaphragm pumps. These applications are merely exemplary and many other fluid transfer applications may be suitable.

Figure 1:
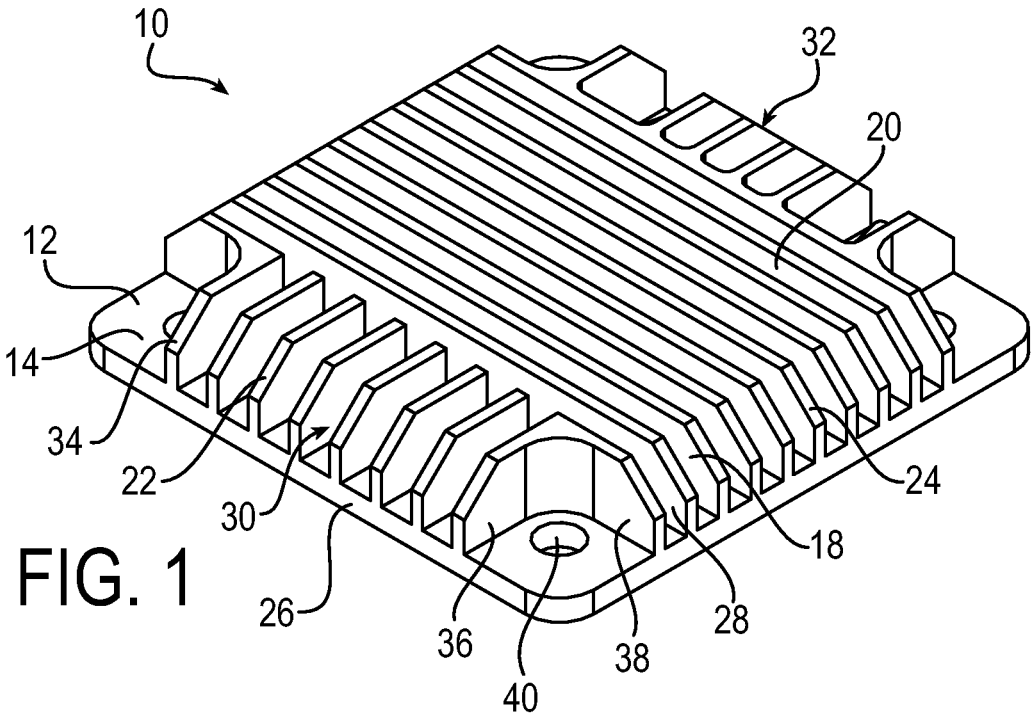
FIG. 1 is a sectional view of a first side of a plate-type cover for a pump assembly according to an embodiment of the present invention.
Figure 2:
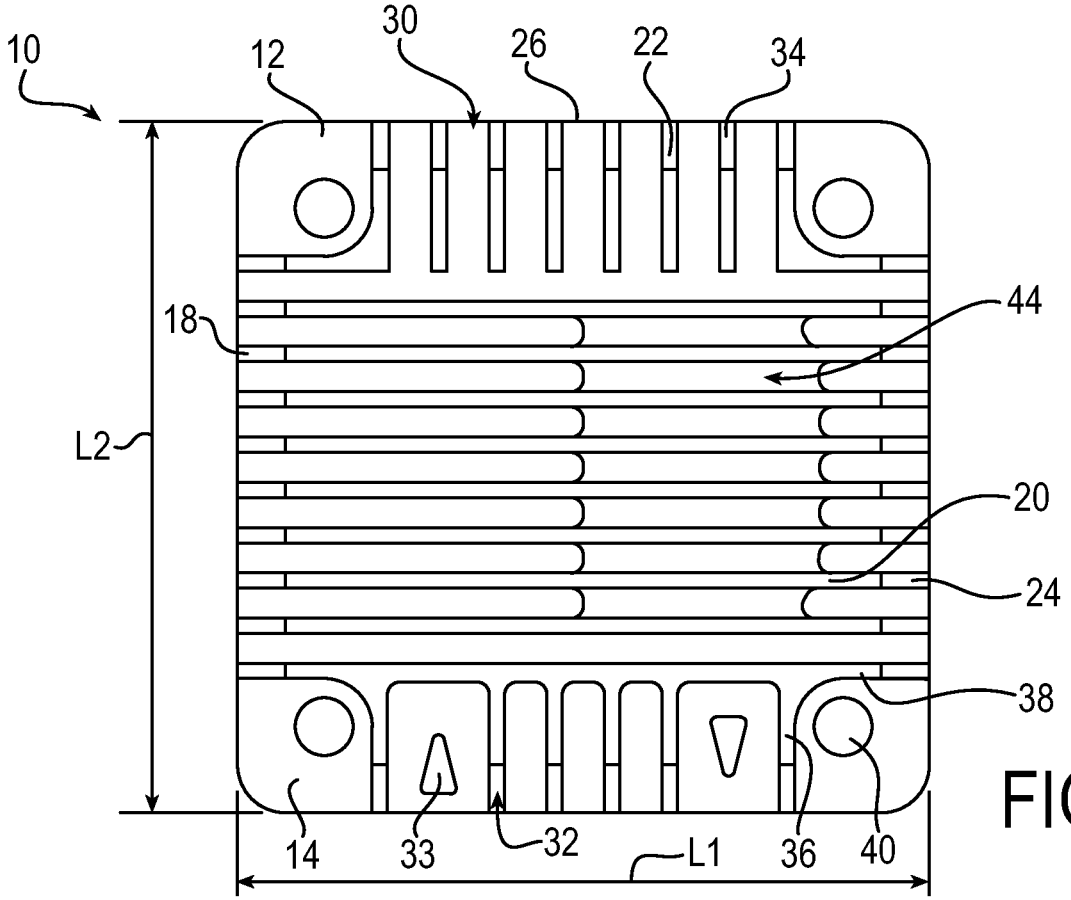
FIG. 2 is a top view of the cover of FIG. 1 showing a plurality of external fins.
Figure 3:
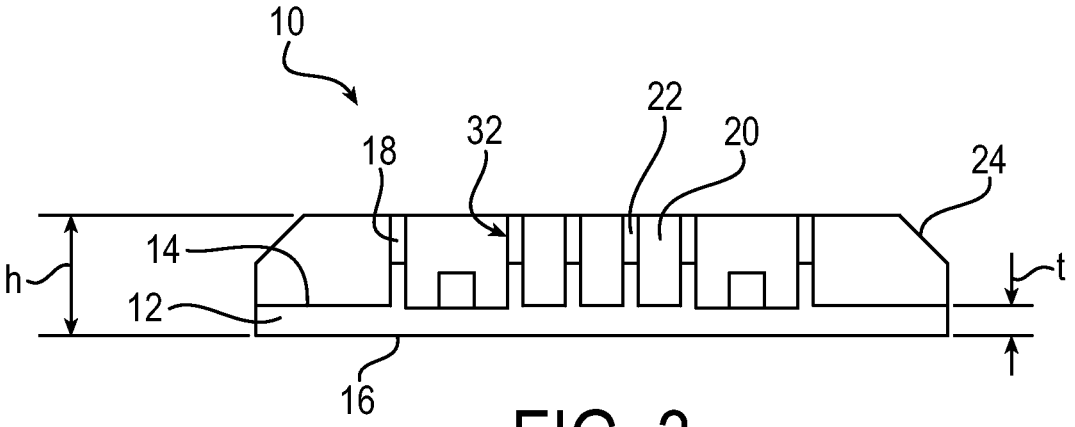
FIG. 3 is a side view of the cover of FIG. 1.
Figure 4:
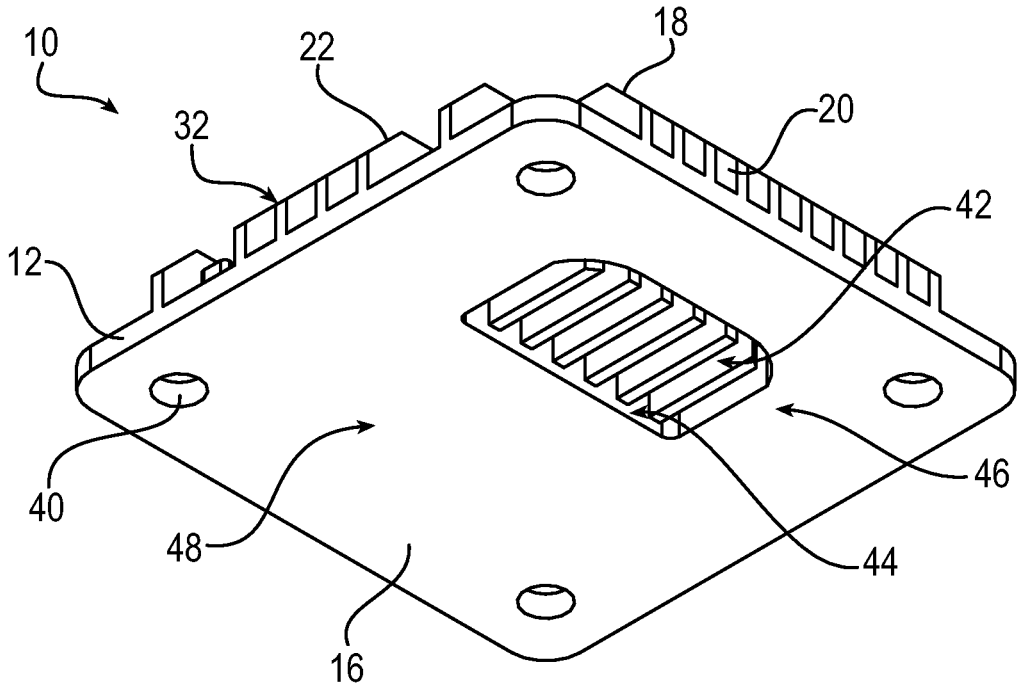
FIG. 4 is a sectional view of a second side of the cover of FIG. 1.
Figure 5:
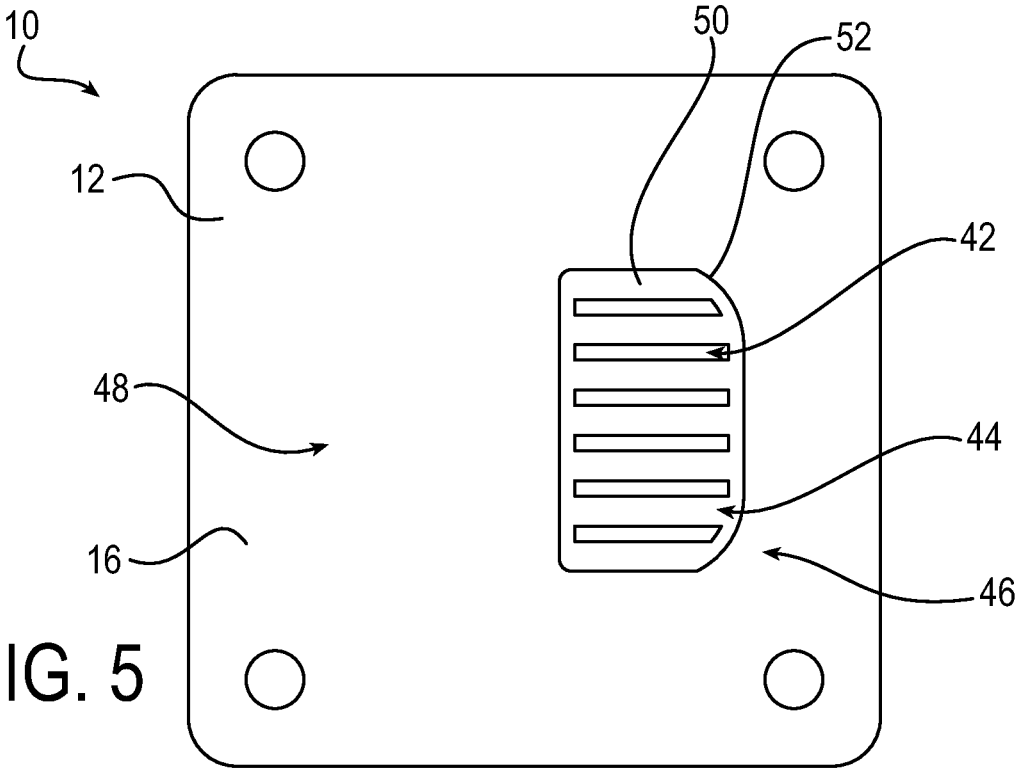
FIG. 5 is a bottom view of the cover of FIG. 1 showing a plurality of internal fins.

Referring first to FIGS. 1-5, a cover 10 for a pump or compressor in a pump assembly according to an exemplary embodiment of the present application is shown. The cover 10 includes a main plate body 12. The main plate body 12 has a first surface or a top surface 14, as best shown in FIGS. 1-3, and a second surface or a bottom surface 16 that opposes the first surface 14, as best shown in FIGS. 3-5. The first surface 14 and the second surface 16 may be substantially flat and extend along planes that are parallel. The first surface 14 may be an external surface of the cover 10 that faces away from the pump or compressor when assembled thereto, and the second surface 16 may be an internal surface that faces toward the pump or compressor when assembled thereto.

The main plate body 12 may have any suitable shape and the shape may be dependent on the application. The main plate body 12 is plate-like in shape meaning that a thickness t of the main plate body 12 is small relative to lengths L1, L2 of the main plate body 12. As shown in FIGS. 1-5, the main plate body 12 may be rectangular in shape and have corners that are curved. The corners may form sharp corners in other embodiments. In still other exemplary embodiments, the main plate body 12 may be cylindrical or hexagonal in shape. Other polygonal shapes may also be suitable. Many shapes and dimensions may be suitable and the main plate body 12 may be sized for any particular application. The shape may be complementary to a shape of the chamber over which the cover 10 is arranged. For example, the main plate body 12 may be cylindrical in shape to fit over a circular chamber.

The first surface 14 of the main plate body 12 has a plurality of external fins 18 that are formed on the first surface 14 and protrude outwardly from the first surface 14. The external fins 18 may be formed integrally with the main plate body 12 and may extend normal to the first surface 14. The plurality of external fins 18 may include one set of fins that are arranged in a single parallel direction. In other exemplary embodiments, the plurality of external fins 18 may include a first set of external fins 20 and a second set of external fins 22 that are perpendicularly arranged relative to each other. The first set of external fins 20 may include fins that extend along a first length L1 of the main plate body 12. The fins may extend along an entire length of the first length L1 or in other exemplary embodiments, the fins may extend less than the entire length L1.

The fins arranged in the first set of external fins 20 may be straight and in a parallel arrangement. The arrangement may include the fins being equidistantly spaced such that the fins are arranged in an ordered arrangement. In other exemplary embodiments, the fins may be curved or angled relative to the main plate body 12, and/or the spacing between the fins may be non-uniform such that the fins are arranged in a disordered arrangement. Providing fins that are not straight, or curved or angled, may be particularly advantageous in enabling turbulent flow in the system. The fins in the first set of external fins 20 may have any suitable shape and the main bodies of the fins may be rectangular in shape with the longest length of the fin extending along the first length L1 of the main plate body 12. The fins may each have at least one chamfered portion 24, or a chamfered portion at each end of the corresponding fin.

The second set of external fins 22 includes a plurality of fins that extend along a second length L2 of the main plate body 12. In an exemplary embodiment, the first length L1 and the second length L2 may be similar such that the main plate body 12 is substantially square-shaped. In other exemplary embodiments, one of the lengths L1, L2 may be greater than the other such that the main plate body 12 is rectangular. The fins arranged in the second set of external fins 22 may extend along only a portion of the second length L2, and the fins may extend along a portion that is less than half of the entire second length L2. The fins in the second set of external fins 22 may also be rectangular in shape and have lengths that are shorter than the fins in the first set of external fins 20.

The fins arranged in the second set of external fins 22 may extend from an edge 26 of the main plate body 12 toward a first fin 28 of the first set of external fins 20. The first set of external fins 20 may be spaced from the edge 26. The second set of external fins 22 may include two groups of fins that are arranged on opposite sides of the first set of external fins 20. Both groups of fins may be arranged parallel to each other such that all of the fins in the second set of external fins 22 are parallel. A first group of fins 30 arranged in the second set of external fins 22 on one side of the first set of external fins 20 may be greater in number than a number of the fins in a second group of fins 32 that is arranged in the second set of external fins 22 on the opposite side of the first set of external fins 20. As shown in FIGS. 2 and 3, the second group of fins 32 may include additional thermal features 33 that are adjacent the fins and have a different shape than the shape of the external fins 18. All of the fins arranged in the second set of external fins 22 may be equidistantly spaced and arranged in an ordered pattern. In other exemplary embodiments, the fins arranged in the second set of external fins 22 may have non-uniform spacing and be arranged in a non-ordered pattern.

The second set of external fins 22 may also include fins having chamfered portions 34 on the ends thereof. The chamfered portion 34 may be formed on one end of the corresponding fin and the opposite end may be straight. A corner finned portion 36 may be arranged at each corner of the main plate body 12. The corner finned portion 36 may include a fin arranged in the first set of external fins 20 and a fin arranged in the second set of external fins 22. The fins in the different sets may be integrally connected by a curved portion 38 of the corner finned portion 36. The corner finned portion 36 may also curve around a bolt hole 40 that is formed in the main plate body 12. A plurality of bolt holes may be formed in the main plate body 12 for mounting the cover 10 to the pump or air compressor. Any suitable pattern of bolt holes may be used. For example, four bolt holes may be provided such that the cover 10 includes a bolt hole in each corner of the cover 10 that is equidistantly spaced relative to the other bolt holes. Fewer than four or more than four bolt holes may be suitable.

Each of the external fins 18 may have a same height h, as best shown in FIGS. 1 and 3. The height h of the external fins 18 may be greater than the thickness t of the main plate body 12 and less than the lengths L1, L2 of the main plate body 12. In other exemplary embodiments, the height h of the external fins 18 may be variable and dependent on the application. For example, the different sets of external fins may have different heights. The external fins 18 may have many different configurations, geometries, and shapes.

As best shown in FIGS. 4 and 5, the main plate body 12 includes a plurality of internal fins 42 that may be formed integrally with the main plate body 12. The internal fins 42 are arranged proximate the second surface 16, as compared with the external fins 18, and extend in a direction that is opposite to the direction in which the external fins 18 extend. The internal fins 42 may extend parallel to each other and be straight and rectangular in shape. The main body of each internal fin may have sharp edges and corners. An arrangement of the internal fins 42 may include the internal fins 42 being equidistantly spaced. Other shapes including non-linear shapes may be suitable, and in other exemplary embodiments, the internal fins 42 may be curved or angled relative to the main plate body 12 and/or the spacing between the fins may be non-uniform.

The pattern of the internal fins 42 may be ordered such that the internal fins 42 are aligned in a row and/or a column, or disordered such that the internal fins 42 have a staggered arrangement. The internal fins 42 may extend normal to the main plate body 12 in a direction that opposes the direction in which the external fins 18 extend relative to the main plate body 12. As best shown in FIG. 4, the internal fins 42 may extend parallel with the first set of external fins 20 and perpendicular to the second set of external fins 22. In other exemplary embodiments, the internal fins 42 may extend parallel with the second set of fins 22 and perpendicular to the first set of external fins 20. In still other exemplary embodiments, the internal fins 42 may extend transversely relative to any of the sets of the external fins 18.

In an exemplary embodiment, the internal fins 42 may extend outwardly from the second surface 16. The internal fins 42 may be integrally formed with the second surface 16 or separately formed and joined to the second surface 16. The internal fins 42 may extend from the second surface 16 and outwardly from the main plate body 12 such that the internal fins 42 extend downwardly into a pump or compressor outlet chamber. As shown in FIG. 4, the main plate body 12 may define a pocket or chamber 44 that opens to the second surface 16 and is configured to surround and support the internal fins 42. The chamber 44 may be a machined feature formed in the main plate body 12 such that the chamber 44 extends through the thickness t of the main plate body 12. The chamber 44 may also be referred to as a cavity or recess. The chamber 44 may extend into the first set of external fins 20, as shown in FIG. 2, such that the chamber 44 protrudes from the first surface 14 of the main plate body 12.

The chamber 44 and the internal fins 42 formed therein may only be arranged along a portion of the main plate body 12. For example, the chamber 44 may be formed in a region 46 of the second surface 16 of the main plate body 12 that is offset from a center of the main plate body 12 and corresponds to an outlet of the pump or compressor when the cover 10 is assembled or mounted to the pump or compressor, such that the chamber 44 and the internal fins 42 will be arranged in the flow path of the pump or compressor outlet. An adjacent region 48 of the second surface 16 may correspond to an inlet of the pump or compressor and internal fins may or may not be formed on the adjacent region 48. A height of the internal fins 42 may extend to the second surface 16 such that the internal fins 42 are surrounded by the chamber 44. In other exemplary embodiments, the fins may extend past the second surface 16 to extend past the main plate body 12 and downwardly into a pump or compressor outlet chamber.

The internal fins 42 may extend normal to a base surface 50 of the chamber 44 that defines a closed side of the chamber 44. The internal fins 42 may extend from the base surface 50 to the second surface 16. The length of the chamber 44 may be elongated relative to a width and the internal fins 42 may be arranged along the length of the chamber 44. The internal fins 42 may be elongated along the chamber width, which may be slightly larger than the length of the internal fins 42, such that the internal fins 42 do not contact the walls of the chamber 44. Any number of internal fins 42 may be used. As shown in FIG. 5, six internal fins 42 may be used, but fewer or more than six internal fins 42 may also be suitable. Each of the internal fins 42 may have a similar length, width, and height. In other exemplary embodiments, the dimensions of the internal fins 42 may be non-uniform such that the internal fins 42 may have different lengths, widths, or heights.

The chamber 44 may have any suitable shape, and the shape may be dependent on the shape of the outlet which the chamber 44 faces. For example, the shape of the chamber 44 may be complementary in shape to a discharge outlet of the pump or the compressor. The chamber 44 may be formed on less than half of the surface area of the second surface 16, such that the internal fins 42 may be formed on a smaller area of the main plate body 12 as compared with the external fins 18 which may be formed on most of the surface area of the first top surface. As shown in FIGS. 4 and 5, the chamber 44 may be rectangular in shape and have at least one wall 52 that is curved along the plane of the main plate body 12. The walls that form the chamber 44 may be straight relative to the plane of the main plate body 12. As shown in FIG. 4, the length of the chamber 44 may extend parallel with the second set of external fins 22. and the width of the chamber 44 may extend parallel with the first set of external fins 20. In other exemplary embodiments, the chamber 44 may have a shape that is oval, circular, square, hexagonal, or any other suitable polygon. The internal fins 42 arranged in the chamber 44 may be formed to have a maximum heat transfer surface area such that the shape of the internal fins 42 may also be dependent on the shape of the chamber 44.

Figure 6:
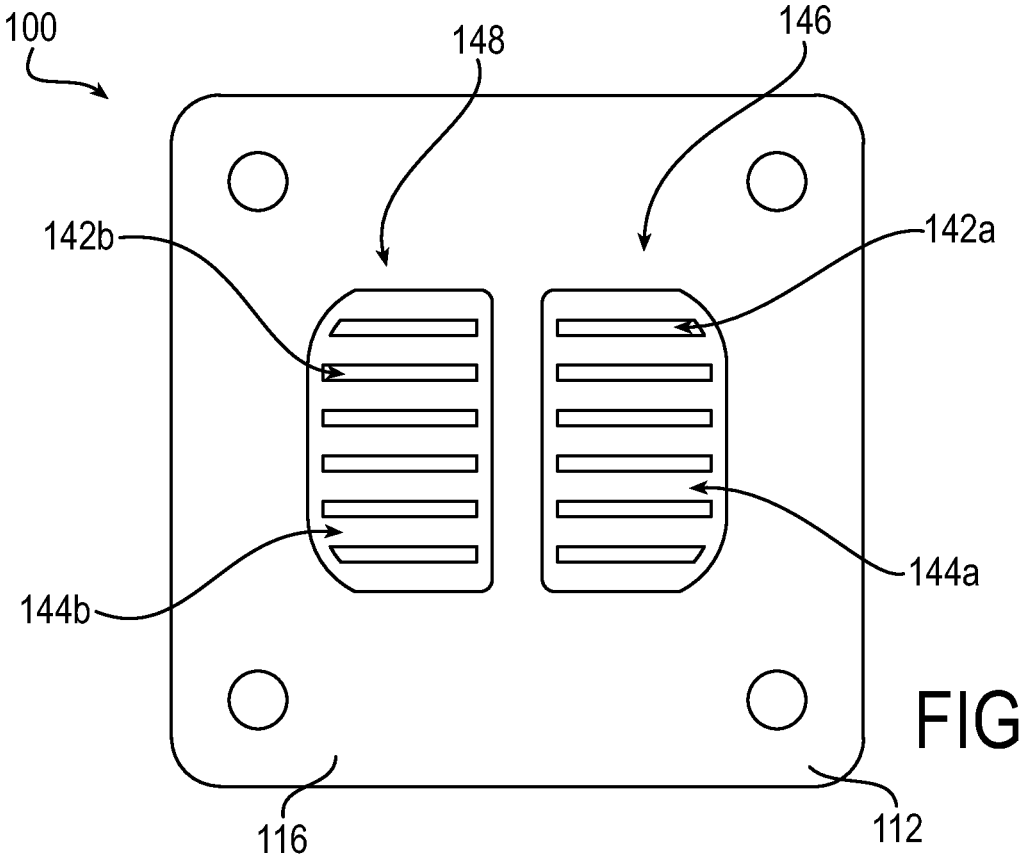
FIG. 6 is a bottom view of a cover for a pump assembly according to another embodiment of the present invention in which the cover has more than one set of internal fins.

Referring now to FIG. 6, a cover 100 having more than one chamber 144*a*, 144*b*, and more than one set of internal fins 142*a*, 142*b*, is shown in accordance with another exemplary embodiment of the present application. The cover 100 includes the main plate body 112 which may include the features of the main plate body 12 and the external fins 20 shown in FIGS. 1-5. The second or bottom surface 116 of the main plate body 112 includes the chamber 144*a* that is formed in the region 146 of the second surface 116 and has features that are similar to the chamber 44 of the cover 10 shown in FIGS. 4 and 5. In the adjacent region 148 of the second surface 116, an additional chamber 144*b* may be formed, such that the chambers 144*a*, 144*b* each correspond to one of the inlet and the outlet of the pump or compressor when the cover 10 is mounted. Accordingly, the temperature of fluid that is both entering and exiting the pump assembly may be controlled using the internal fins 142*a*, 142*b*. In other exemplary embodiments, more than one set of internal fins may correspond to the outlet.

The additional chamber 144*b* and the second set of internal fins 142*b* may be identical or nearly identical in shape and size to the chamber 144*a* and the first set of internal fins 142*a*. Both the first set of internal fins 142*a*, 142*b* are straight and are arranged parallel with each other and normal relative to the plane of the main plate body 112. The chambers 144*a*, 144*b* and the sets of internal fins 142*a*, 142*b* are symmetrically arranged relative to a center of the main plate body 112. In other exemplary embodiments, more than two sets of internal fins may be used, and the sets of internal fins may be spaced about the second surface 116. The arrangement of the chambers and the internal fins on the main plate body 112 may be dependent on the location of an inlet and outlet of the pump or compressor. Although identically-formed chambers and fins are shown in FIG. 6, different chambers and sets of fins having different shapes and sizes may also be suitable.

Figure 7:
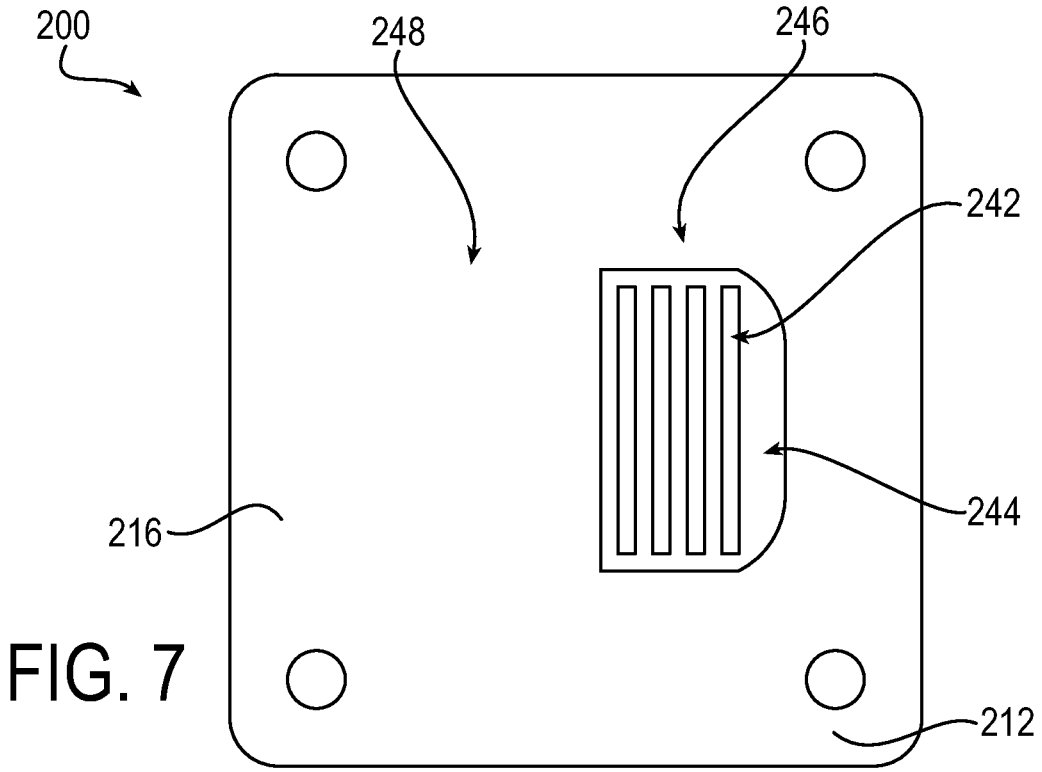
FIG. 7 is a bottom view of a cover for a pump assembly according to another embodiment of the present invention in which a set of internal fins is elongated along a length of a chamber of the cover.

Referring now to FIG. 7, a cover 200 having a set of internal fins 242 that are elongated along the length of the chamber 244 is shown in accordance with another exemplary embodiment of the present application. The cover 200 includes the main plate body 212 which may include the features of the main plate body 12 and the external fins 20 shown in FIGS. 1-5. The second or bottom surface 216 of the main plate body 212 includes the chamber 244 that is formed in the region 246 which is off-center relative to the center of the second surface 216. The adjacent region 248 may not include a chamber and a set of internal fins, or in other exemplary embodiments, another chamber and another set of internal fins may be provided in the adjacent region 248. The region 246 may be configured to cover the outlet of the pump or compressor when the cover 210 is assembled.

The chamber 244 may have a similar shape to the chamber 44 of the cover 10 shown in FIGS. 4 and 5. As shown in FIG. 7, the set of internal fins 242 are elongated along the length of the chamber 244 such that the set of internal fins 242 are spaced along the width of the chamber 244. In contrast to the set of internal fins 42 shown in FIGS. 4 and 5, the set of internal fins 242 may extend parallel with the second set of external fins 22 and perpendicular to the first set of external fins 20. Arranging the set of internal fins 242 to be parallel with the length of the chamber 244 may enable fewer internal fins 242 to be used while maintaining a similar working surface area of the internal fins. For example, four internal fins may be arranged in the chamber 244 as compared with the six internal fins shown in FIGS. 4 and 5. The arrangement and number of the internal fins may be dependent on the application.

Figure 8:
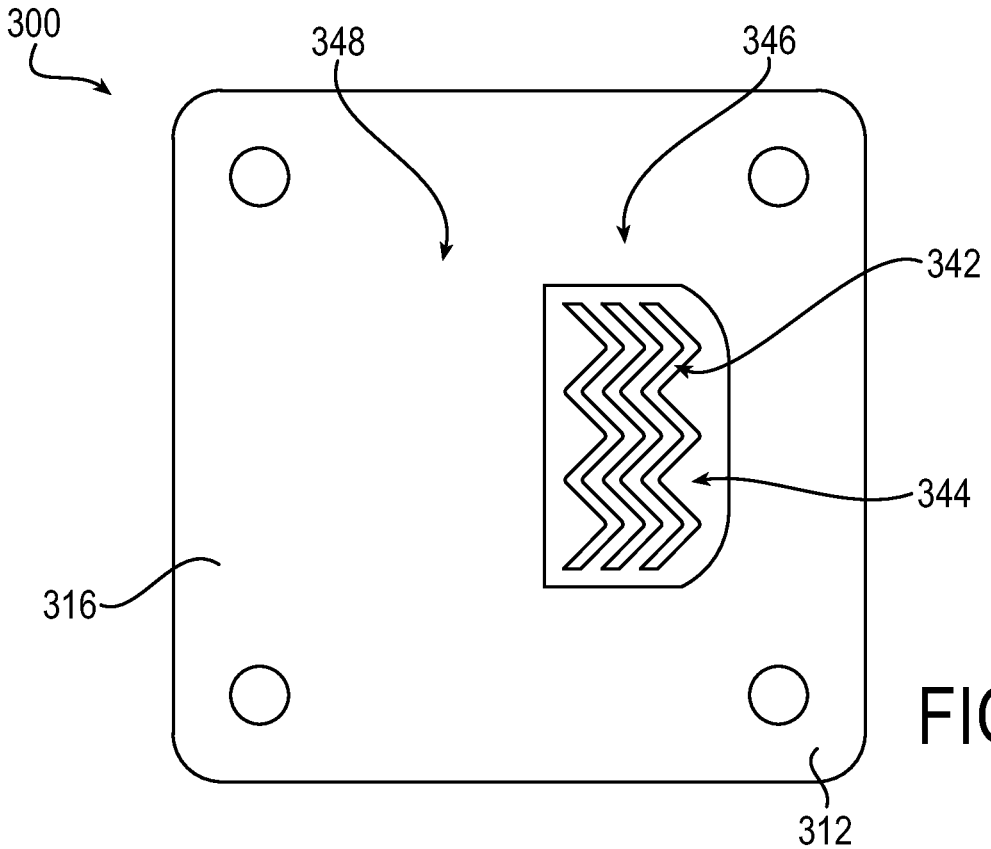
FIG. 8 is a bottom view of a cover for a pump assembly according to another embodiment of the present invention in which a set of internal fins has a wavy and non-linear pattern.

Referring now to FIG. 8, a cover 300 having a set of internal fins 342 arranged in a non-linear or wavy pattern is shown in accordance with another exemplary embodiment of the present application. The cover 300 includes the main plate body 312 which may include the features of the main plate body 12 and the external fins 20 shown in FIGS. 1-5. The second or bottom surface 316 of the main plate body 312 includes the chamber 344 that is formed in the region 346 which is off-center relative to the center of the second surface 316. The adjacent region 348 may not include a chamber and a set of internal fins, or in other exemplary embodiments, another chamber and set of internal fins may be provided in the adjacent region 348. The region 346 may be configured to cover the outlet of the pump or compressor when the cover 310 is assembled.

The chamber 344 may have a similar shape to the chamber 44 of the cover 10 shown in FIGS. 4 and 5. As shown in FIG. 8, the set of internal fins 342 are elongated along the length of the chamber 344 such that the set of internal fins 342 are spaced along the width of the chamber 344. In contrast to the set of internal fins 42 shown in FIGS. 4 and 5, the set of internal fins 342 may extend parallel with the second set of external fins 22 and perpendicular to the first set of external fins 20. The set of internal fins 342 includes fins having a non-linear shape, such as a wavy or zigzag shape. Other non-linear shapes may be suitable, such as shapes that are meandering, serpentine, sinuous, or irregular. Each of the internal fins in the set of internal fins 342 may have the same shape or a different shape. Three non-linear internal fins may be suitable, and more than three non-linear internal fins or less than three non-linear internal fins may be suitable in other exemplary embodiments.

The cover 10, 100, 200, 300 and the external and internal fins 18, 42, 142, 342, 442 may be formed of any suitable materials and the materials may be dependent on the application. Metal materials and alloy metal materials may be suitable. An example of a suitable material is aluminum. Any suitable manufacturing process may be used to form the cover 10, 100, 200, 300 and examples of suitable processes include injection molding, casting, compression molding, welding, machining, additive manufacturing, and any combination thereof. Additive manufacturing, such as ultrasonic additive manufacturing, may be advantageous for forming fin shapes having more complex geometries. The manufacturing method may be dependent on whether the external and internal fins are formed integrally with the main plate body 12 or separate from the main plate body 12 for subsequent attachment or insertion in the main plate body 12. For example, the internal or external fins may be formed as part of a separate insert component that may be attached to or inserted in the cover 10, 100, 200, 300. The separate insert may be pressed in, locked in, or glued in place with a heat transfer adhesive.

Figure 9:
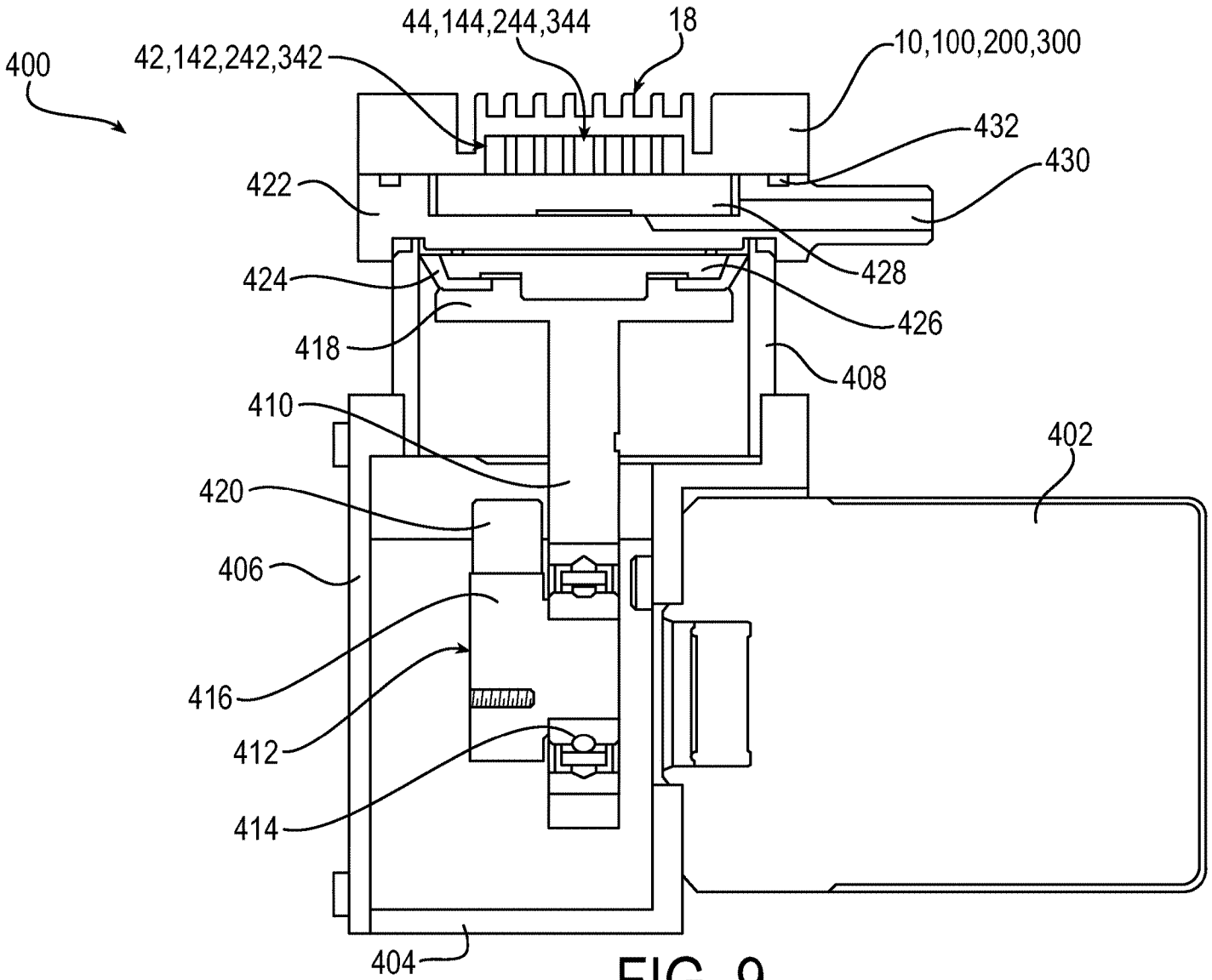
FIG. 9 is a cross-sectional view of an exemplary application for the cover of FIG. 1 in which an air compressor includes the cover.

Referring now to FIG. 9, an exemplary application for the cover is shown. The exemplary application includes an air compressor 400 to which a cover 10, 100, 200, 300 is assembled. The air compressor 400 includes a motor 402 and a housing 404 that is mounted on the motor 402. The housing 404 may be enclosed by a cover 406 that is arranged at a side of the housing 404 that is opposite a side of the housing 404 to which the motor 402 is mounted. The housing 404 is attached to a cylinder block 408 that contains a piston connecting rod 410. The cylinder block 408 may be arranged to extend from a top of the housing 404 and normal relative to the motor 402. The piston connecting rod 410 is connected to an eccentric bearing assembly 412 that is supported within the housing 404 and includes a bearing 414 and an eccentric 416. The piston connecting rod 410 may be clamped to the eccentric bearing assembly 412, and the eccentric bearing assembly 412 may be connected to the motor 402 such that the eccentric bearing assembly 412 drives the piston connecting rod 410 to move a piston 418 within the cylinder block 408. In exemplary embodiments, a counterweight 420 may be arranged on the eccentric 416 of the eccentric bearing assembly 412.

The cylinder block 408 may include a head 422 that is mounted to a top end of the cylinder block 408 opposite the housing 404. The cylinder block 408 may further contain a sealing element 424 arranged between the piston 418 and the head 422. Any suitable sealing element 424 may be used. For example, a cup seal may be provided to contain pressure on one side of the piston 418 and prevent leakage. A washer 426 may also be provided to hold the cup seal 424 on the outer lip of the piston 418. The head 422 includes a discharge chamber 428 and a discharge line 430 connected to the discharge chamber 428. The discharge chamber 428 forms the outlet, e.g. the gas outlet, of the air compressor 400. The cover 10, 100, 200, 300 may be sealed against the head 422 and the discharge chamber 428. At least one gasket 432 may be arranged between the head 422 and the cover 10, 100, 200, 300. In other exemplary embodiments, the head 422 may also include a suction chamber, a suction valve, and/or a discharge valve. For example, flat umbrella check valves may be used. Inlet and outlet check valves may be used to produce flow in a single direction to form either a vacuum on the inlet or a positive pressure on the outlet.

The chamber 44, 144, 244, 344 of the cover 10, 100, 200, 300 is open toward the discharge chamber 428 such that the internal fins arranged in the chamber 44, 144, 244, 344 are arranged in the airflow path of the compressor outlet. The external fins 18 extend away from the air compressor 400 and opposite the internal fins, such that one side of the cover 10, 100, 200, 300 is sealed and one side is open. During operation of the air compressor 400, hot compressed air flows through the discharge chamber 428 toward the discharge line 430 to be discharged from the air compressor 400. The heat in the compressed air is transferred to the internal fins in the chamber 44, 144, 244, 344 and the heat flows through the cover 10, 100, 200, 300. Thus, the cover 10, 100, 200, 300 having internal and external fins enables the heat to be efficiently transferred away from the outlet gas that moves out of the discharge line 430.

Figure 10:
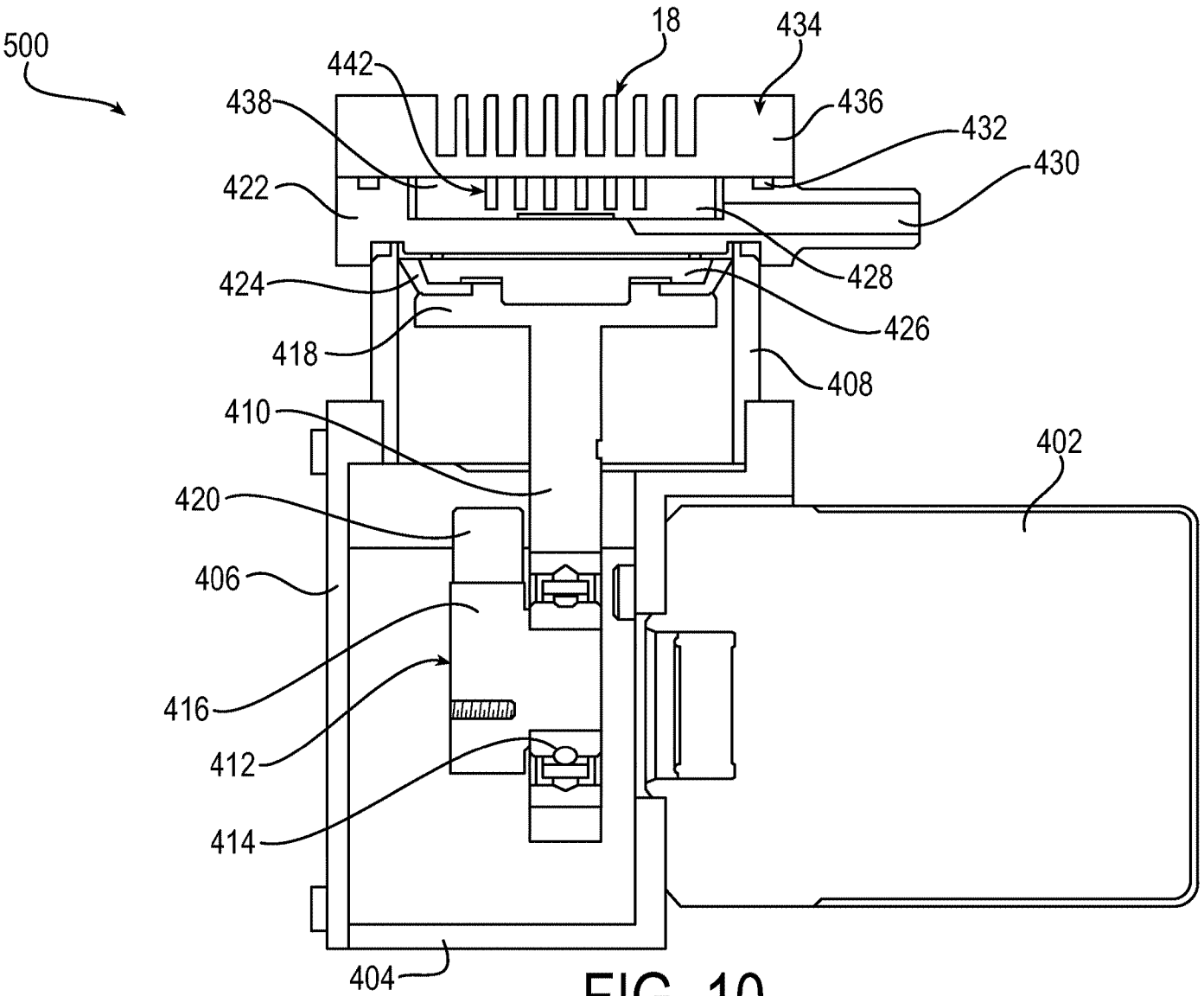
FIG. 10 is a cross-sectional view of the exemplary application shown in FIG. 9 and further including another embodiment of the of the present invention in which a set of internal fins extends outwardly from a main plate body of the cover.

FIG. 10 shows an air compressor 500 that has features that are similar to the features of the air compressor 400 shown in FIG. 9, and a cover 434 with internal fins that protrude from a main plate body 436 of the cover 434 in accordance with another exemplary embodiment of the present application. The main plate body 436 has features that are similar to the features of the other main plate bodies described herein, but has a bottom surface 438 without a pocket or chamber defined in the main plate body 436. The cover 434 includes the external fins 18 that extend away from air compressor 500 and further includes a plurality of internal fins 442 that protrude outwardly from the bottom surface 438 of the main plate body 436 in a direction that is opposite to the direction in which the external fins 18 extend. Both directions may be normal relative to the plane of the main plate body 436. The directions may be directly opposite to each other. In other exemplary embodiments, either set of fins may be angled or curved relative to a plane that is normal to the plane of the main plate body 436. The plurality of internal fins 442 extend beyond the thickness of the main plate body 436 and into the discharge chamber 428 of the head 422. Accordingly, the internal fins 442 extend inwardly toward the cylinder block 408 and the external fins 18 extend outwardly away from the cylinder block 408.

Similarly to the internal fins 42, 142, 242, 342 shown in FIG. 9, the internal fins 442 are interposed between the gas outlet of the air compressor 500 and the plurality of external fins 18 for heat transfer. The plurality of internal fins 442 may be offset relative to a midpoint of the main plate body 436 such that the plurality of internal fins 442 are configured to only extend into the discharge chamber 428 when the cover 434 is properly aligned on the air compressor 500. Areas of the bottom surface 438 that are adjacent the area from which the internal fins 442 extend may lie flush with corresponding surfaces of the head 422. The arrangement of the internal fins 442 will be dependent on the shape of the discharge chamber 428 and the head 422. Each of the plurality of internal fins 442 may extend parallel with each other and perpendicular to the bottom surface 438 of the main plate body 436, and may have any suitable shapes and/or patterns, such as the shapes and patterns of any of the internal fins described herein. The plurality of internal fins 442 may be formed integrally with the main plate body 436 or in other exemplary embodiments, the plurality of internal fins 442 may be formed separately and integrated to or joined with the main plate body 436.

The cover 10, 100, 200, 300, 434 according to the present application is advantageous in providing the ability to dissipate heat that is generated in a pump assembly, such as during the compression of air in an air compressor. Dissipating heat is advantageous since the temperature of the air that is outputted from the air compressor system impacts the efficiency of a device that receives the air from the compressor for operation of the device. Using the cover 10, 100, 200, 300, 434 according to the present application is particularly advantageous in that the temperature of the air, or another fluid in other exemplary applications, may be reduced by approximately 10 degrees as compared with conventional pumps or compressors.

A cover for an air compressor or a pump in a pump assembly includes a main plate body having a first surface and a second surface opposite from the first surface, a plurality of external fins that are formed on the first surface and protrude outwardly from the first surface, and a plurality of internal fins that are arranged proximate the second surface and extend in an opposite direction relative to a direction in which the plurality of external fins extend, such that heat from the air compressor or pump is received by the plurality of internal fins and flows through the main plate body and a temperature of a fluid exiting the air compressor or pump is reduced.

The cover may be a plate fin heat exchanger.

The plurality of external fins and the plurality of internal fins may be integrally formed with the main plate body.

The plurality of external fins and the plurality of internal fins may extend normal to the first surface and the second surface.

The plurality of external fins and the plurality of internal fins may be perpendicularly arranged relative to each other.

The plurality of internal fins may extend parallel with at least some of the plurality of external fins.

The plurality of external fins and the plurality of internal fins may be straight.

The plurality of internal fins may be offset from a center of the main plate body.

The plurality of internal fins may be equidistantly spaced.

The plurality of internal fins may be arranged in an ordered pattern.

The plurality of internal fins may have a serpentine or wavy pattern.

The plurality of internal fins may include a first set of internal fins and a second set of internal fins.

The cover may include a chamber that is formed in the main plate body and opens to the second surface, and the chamber may have a base surface defining a closed side of the chamber, and the plurality of internal fins may extend from the base surface of the chamber to the second surface of the main plate body.

The chamber may extend from the second surface through the main plate body and protrude from the first surface.

The plurality of internal fins may extend along an elongated length of the chamber and are spaced in a direction of a width of the chamber.

The plurality of internal fins may extend along a width of the chamber and are spaced in a direction of an elongated length of the chamber.

The plurality of internal fins may protrude from the second surface and outwardly from the main plate body.

The cover may be formed of aluminum.

The cover may be used in a pump assembly having a pump or a compressor, a motor, and a cylinder assembly connected to the motor, with the cover being connected to the cylinder assembly such that the second surface of the cover faces the cylinder assembly.

The pump assembly may include a gas outlet arranged in a head portion of the cylinder assembly.

The plurality of internal fins may be interposed between the gas outlet and the plurality of external fins.

A method of reducing a temperature of an output fluid in a pump assembly including a pump or compressor includes providing a plate fin heat exchanger having a main body, a cylinder facing surface that faces a cylinder of the air compressor, an outer surface opposite from the cylinder facing surface, a plurality of external fins that extend outwardly from the outer surface, and a plurality of internal fins that extend inwardly toward the cylinder and in a direction opposite relative to the plurality of external fins, and supplying compressed air into a pump chamber of the cylinder, wherein heat from the compressed air is transferred to the plurality of internal fins and flows through the cover.

Although the invention has been shown and described with respect to a certain embodiment or embodiments, it is obvious that equivalent alterations and modifications will occur to others skilled in the art upon the reading and understanding of this specification and the annexed drawings. In particular regard to the various functions performed by the above described elements (components, assemblies, devices, compositions, etc.), the terms (including a reference to a "means") used to describe such elements are intended to correspond, unless otherwise indicated, to any element which performs the specified function of the described element (i.e., that is functionally equivalent), even though not structurally equivalent to the disclosed structure which performs the function in the herein illustrated exemplary embodiment or embodiments of the invention. In addition, while a particular feature of the invention may have been described above with respect to only one or more of several illustrated embodiments, such feature may be combined with one or more other features of the other embodiments, as may be desired and advantageous for any given or particular application.

What is claimed is:

1. A cover for an air compressor or a pump in a pump assembly, the cover comprising:

a main plate body having a first surface and a second surface opposite from the first surface;

a plurality of external fins that are formed on the first surface and protrude outwardly from the first surface;

a plurality of internal fins that are arranged proximate the second surface and extend in an opposite direction relative to a direction in which the plurality of external fins extend; and a chamber that is formed in the main plate body and opens to the second surface, wherein the chamber has a base surface defining a closed side of the chamber, wherein at least a portion of the base surface is positioned intermediate the plurality of external fins and the plurality of internal fins, and the plurality of internal fins extends from the base surface of the chamber to the second surface of the main plate body, wherein heat from the air compressor or pump is received by the plurality of internal fins and flows through the main plate body, whereby a temperature of a fluid exiting the air compressor or pump is reduced.

2. The cover according to claim 1, wherein the cover is a plate fin heat exchanger.

3. The cover according to claim 1, wherein the plurality of external fins and the plurality of internal fins are integrally formed with the main plate body.

4. The cover according to claim 1, wherein the plurality of external fins and the plurality of internal fins extend normal to the first surface and the second surface.

5. The cover according to claim 1, wherein the plurality of external fins and the plurality of internal fins are perpendicularly arranged relative to each other.

6. The cover according to claim 1, wherein the plurality of internal fins extends parallel with at least some of the plurality of external fins.

7. The cover according to claim 1, wherein the plurality of external fins and the plurality of internal fins are straight.

8. The cover according to claim 1, wherein the plurality of internal fins are offset from a center of the main plate body.

9. The cover according to claim 1, wherein the plurality of internal fins are equidistantly spaced.

10. The cover according to claim 1, wherein the plurality of internal fins are arranged in an ordered pattern.

11. The cover according to claim 1, wherein the plurality of internal fins have a serpentine or wavy pattern.

12. The cover according to claim 1, wherein the plurality of internal fins includes a first set of internal fins and a second set of internal fins.

13. The cover according to claim 1, wherein the chamber extends from the second surface through the main plate body and protrudes from the first surface.

14. The cover according to claim 1, wherein the plurality of internal fins extend along an elongated length of the chamber and are spaced in a direction of a width of the chamber.

15. The cover according to claim 1, wherein the plurality of internal fins extend along a width of the chamber and are spaced in a direction of an elongated length of the chamber.

16. The cover according to claim 1, wherein the plurality of internal fins protrude from the second surface and outwardly from the main plate body.

17. A pump assembly having a pump or a compressor, the pump assembly comprising:

a motor;

a cylinder assembly connected to the motor; and the cover according to claim 1, wherein the cover is connected to the cylinder assembly and the second surface of the cover faces the cylinder assembly.

18. The pump assembly according to claim 17 further comprising a gas outlet arranged in a head portion of the cylinder assembly, wherein the plurality of internal fins are interposed between the gas outlet and the plurality of external fins.

19. A method of reducing a temperature of an output fluid in a pump assembly including a pump or compressor, the method comprising:

providing a cover having a main body, a cylinder facing surface that faces a cylinder of the air compressor, an outer surface opposite from the cylinder facing surface, a plurality of external fins that extend outwardly from the outer surface, a plurality of internal fins that extend from inwardly toward the cylinder and in a direction opposite relative to the plurality of external fins, and a chamber that is formed in the main plate body and opens to the second surface, wherein the chamber has a base surface and at least a portion of the base surface is positioned intermediate the plurality of external fins and the plurality of internal fins; and supplying compressed air into a pump chamber of the cylinder, wherein heat from the compressed air is transferred to the plurality of internal fins and flows through the cover.

20. A pump assembly having a pump or a compressor, the pump assembly comprising:

a motor;

a cylinder assembly connected to the motor; and a cover connected to the cylinder assembly, the cover comprising:

a main plate body having a first surface and a second surface opposite from the first surface;

a plurality of external fins that are formed on the first surface and protrude outwardly from the first surface;

a plurality of internal fins that are arranged proximate the second surface and extend in an opposite direction relative to a direction in which the plurality of external fins extend, wherein the second surface of the cover faces the cylinder assembly; and a chamber that is formed in the main plate body and opens to the second surface, wherein the chamber has a base surface and at least a portion of the base surface is positioned intermediate the plurality of external fins and the plurality of internal fins, wherein heat from the air compressor or pump is received by the plurality of internal fins and flows through the main plate body, whereby a temperature of a fluid exiting the air compressor or pump is reduced.

* * * * *